United States Patent [19]

Singleton

[11] Patent Number: 4,586,494

[45] Date of Patent: May 6, 1986

[54] ORTHOPAEDIC TRACTION DEVICES

[75] Inventor: Terence Singleton, Stretford, England

[73] Assignee: National Research Development Corp., London, England

[21] Appl. No.: 552,370

[22] Filed: Nov. 16, 1983

[30] Foreign Application Priority Data

Nov. 16, 1982 [GB] United Kingdom ..... 8232623

[51] Int. Cl.[4] ..... A61A 1/02

[52] U.S. Cl. ..... 128/75

[58] Field of Search ..... 128/71, 75

[56] References Cited

U.S. PATENT DOCUMENTS

| | | | |
|---|---|---|---|
| 2,638,091 | 5/1953 | Varco | 128/75 |
| 2,966,906 | 1/1961 | Wiltrout | 128/75 |
| 3,176,684 | 4/1965 | Walsh | 128/75 |
| 3,452,747 | 7/1969 | Varco | 128/75 |
| 3,797,483 | 3/1974 | Feldman | 128/75 |
| 3,872,860 | 3/1975 | Noblitt | 128/75 |

*Primary Examiner*—Richard J. Apley
*Assistant Examiner*—Alan W. Cannon
*Attorney, Agent, or Firm*—Cushman, Darby & Cushman

[57] ABSTRACT

A pelvic belt (10) to be worn by a patient whereby tension lines are connectable for the application of tractive force is provided with four pocketed zones (13) or so-called ilia crest sections therealong and two tension line connectors (20) respectively located adjacent alternate ones of said zones.

5 Claims, 1 Drawing Figure

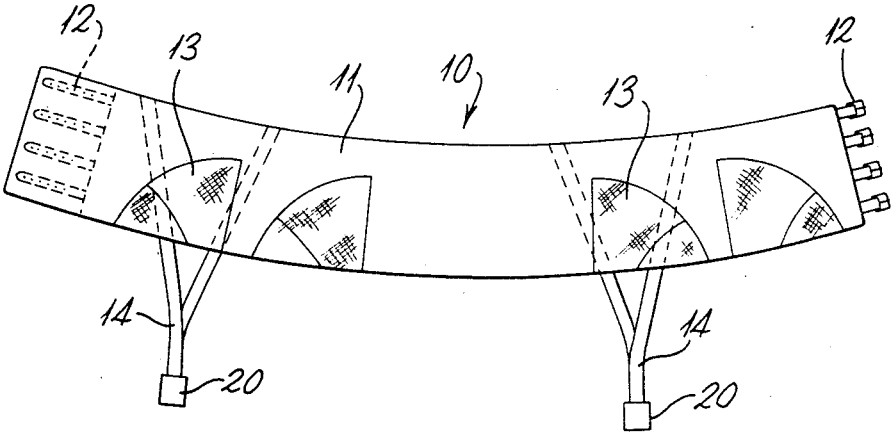
12
13
11
10
13
12
14
20
14
20

ORTHOPAEDIC TRACTION DEVICES

This invention concerns the orthopaedic traction devices and more particularly such devices in the form of a pelvic belt to be worn by a patient whereby tension lines are connectable for the application of tractive force.

Normally such a belt comprises a strip of flexible material having fastening means at its ends, two pocketed zones spaced therealong to seat in use over the lateral pelvic protusions of the patient, and connectors for associated tension lines respectively located adjacent the two zones. Such a belt is intended for use on a supine patient but does not readily allow a different patient disposition to alleviate the incidence of pressure sores because one or other of the connectors will then be located below the patient and cause discomfort and, at the same time, possibly affect the applied tractive force.

An object of the present invention is to improve this situation and to this end provides a pelvic belt having four pocketed zones therealong and two tension line connectors respectively located adjacent alternate ones of such zones.

In use of the invention the belt can be located with the one zones seated over the pelvic protusions and the tension line connectors at the sides of the patient in a normal supine disposition. Alternatively the belt can be located with the other zones seated over the pelvic protusions and the connectors respectively at the front and rear of the patient when lying on his side. Thus the patient disposition can be changed and the belt location adjusted to accommodate the same.

One embodiment of the proposed belt is illustrated in the accompanying drawing.

The illustrated belt comprisesa broad strip of fabric 11 having mutually co-operating fasteners 12 at its opposite ends and four pocketed zones 13 spaced therealong. These zones, commonly referred to as ilia crest sections, are suitably of elasticated material to accommodate more readily to a given patient. A respective pair of tapes 14 are stitched across the belt adjacent each of one pair of alternate zones 13 and project from the lower side thereof in converging manner as the arms of a Y-shape for each pair of tapes with the free end portions being stitched together as the stem of this shape. The free end portions of each pair of tapes serve to secure, in suspended manner, respective connectors 20 for coupling tension lines with the belt during use.

The use of this belt is evident from the earlier description above except to note that the pocketed zones are suitably located so that the fasteners 12 have a frontal location on the patient, but off-set to one side or the other of his body midline dependent upon which pair of pocketed zones are located on his hips.

It should also be mentioned that this belt has been developed particularly for use in association with orthopaedic traction apparatus as described in co-pending Patent Application Ser. No. 465,456 filed Feb. 10, 1983. In this context, the connectors 20 will couple with tension lines in a such manner as to allow adjustment of the length of the latter by the patient himself and the connectors are accordingly located sufficiently close to the belt to enable the patient to reach them easily for this purpose when sitting up from a supine disposition.

The belt is, of course, not intended to be limited to such use and may be employed with other forms of orthopaedic traction apparatus.

I claim:

1. A pelvic belt to be worn by a patient whereby tension lines are connectable for the application of tractive force, said belt having four pocketed zones therealong, said pocketed zones being of common size and constructed to accommodate more readily to a given patient's pelvic protrusions and arranged in two pairs of alternate zones with the spacing between the zones of each pair being the same for alternate location of said pairs on the patient's hips during use, and two tension line connectors respectively located adjacent alternate ones of said zones.

2. A belt according to claim 1 comprising a strip of fabric incorporating said pocketed zones and, at its opposite ends, mutually co-operating fasteners, said zones being positioned along said strip to position said fasteners alternatively to one side and the other of a patient's body midline respectively with alternate location of one pair of said zones and the other pair of said zones on the patient's hips during use.

3. A belt according to claim 2 wherein said connectors are each secured to said strip in suspended manner at a distance therefrom, in use, normally within manual reach of a patient in a sitting position.

4. A belt according to claim 3 wherein each of said connectors is secured to the free ends of a corresponding pair of tapes secured in mutually converging manner across said strip and projecting therefrom in interconnected manner to form a Y-shaped suspension configuration.

5. A belt according to claim 1 wherein said pocketed zones are made with an elasticated material.

* * * * *